United States Patent [19]

Hornivius

[11] Patent Number: 4,694,610

[45] Date of Patent: Sep. 22, 1987

[54] CABLE WINDOW LIFT FOR VEHICLES

[75] Inventor: Lothar Hornivius, Ehringshausen, Fed. Rep. of Germany

[73] Assignee: Kuster & Co. GmbH, Ehringhausen, Fed. Rep. of Germany

[21] Appl. No.: 725,703

[22] Filed: Apr. 22, 1985

[51] Int. Cl.[4] ..... E05F 11/48

[52] U.S. Cl. ..... 49/351; 49/352; 49/375

[58] Field of Search ..... 49/351, 352, 374, 375; 297/347

[56] References Cited

U.S. PATENT DOCUMENTS

| | | | |
|---|---|---|---|
| 1,922,057 | 8/1933 | Menton | 49/375 |
| 3,123,400 | 3/1964 | Paulson | 297/347 |
| 4,314,692 | 2/1982 | Brauer | 49/352 |
| 4,353,185 | 10/1982 | Saigne | 49/352 |

FOREIGN PATENT DOCUMENTS

| | | | |
|---|---|---|---|
| 1079990 | 4/1960 | Fed. Rep. of Germany | 49/352 |
| 983444 | 2/1965 | United Kingdom | 49/352 |
| 8500848 | 2/1985 | United Kingdom | 49/352 |

*Primary Examiner*—Kenneth J. Dorner
*Assistant Examiner*—Gerald A. Anderson
*Attorney, Agent, or Firm*—Quaintance, Murphy & Presta

[57] ABSTRACT

A cable window lift for automobiles and similar vehicles. The cable window lift is characterized by the provision of support arms to support the window pane against tilting in the direction of the plane of the window pane, bening symmetrically arranged in V-type manner to the cable section extending in the direction of displacement when seen perpendicularly to the window pane. The two support arms are operationally joined at one end to carry out a common but oppositely directed motion and rest in fixed but rotatable manner on a stationary component. The other ends of the support arms engage guide slots, grooves or the like which are solidly fastened to the window pane. Furthermore, embodiments are provided wherein the spatial configuration is reversed. While gears are preferably cited as the operational connecting means of the support arms, one illustrative embodiment also discloses a scissor-like connection of the support arms.

4 Claims, 12 Drawing Figures

CABLE WINDOW LIFT FOR VEHICLES

BACKGROUND OF THE INVENTION

The field of the invention is cable window lifts for adjusting automobile window panes.

In window lifts of the prior art, the window pane is fastened to a drive implement which in turn slides on the guide rail. However, such window lifts incur the drawback that the guidance of the drive implement on the guide rail is inadequate per se to reliably prevent the pane from tilting in its plane. Therefore the cable window lifts are mostly suited for those applications where the window pane is provided in the door frame with separate guide grooves extending over a substantial length.

However this is only the case for subdivided window panes. As regards the modern panes which are of one piece, the groove guidance for the forward pane edge as seen in the direction of advance is shortened so that the pane is no longer secured against tilting in its plane.

SUMMARY OF THE INVENTION

It is an object of the present invention to provide a cable window lift remedying this drawback and offering a securing means for the window pane whereby this pane is secured against tilting even for shortened lateral groove guidance.

This problem is solved by a cable window lift having the following features:

(a) a brace (11) rigidly joined to the lower edge of the window pane (1), whether directly or indirectly, and provided with a guidance groove, elongated slot (12, 13) or the like extending perpendicularly to the cable (7); and (b) first and second support arms (18, 19) being provided which, when viewed perpendicularly to the window pane, are arranged symmetrically with respect to the cable section (7) extending in the direction of motion so as to subtend a V-shape, each support arm positively engaging the guidance groove by a shape, pin (**18*a*, 19*a*), guide block or the like mounted at the upper end of the support arm, and both support arms (18, 19) being operationally connected at their lower ends to perform a constrained, joint but oppositely directed rotation and supporting the window pane (1**) at any height against tilting in the direction of the plane of the window pane.

BRIEF DESCRIPTION OF THE DRAWINGS

The appended drawings show the present invention in an illustrative embodiment, wherein.

DESCRIPTION OF THE PREFERRED EMBODIMENTS

Figure 1:
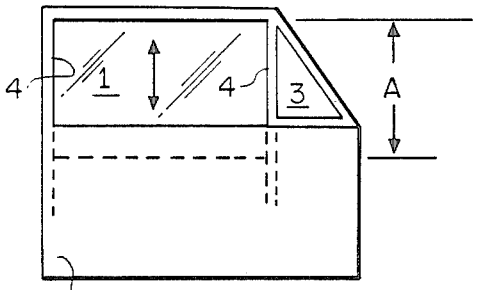
FIG. 1 PRIOR ART
FIG. 1 is a schematic view of a prior art motor vehicle door of an early type with long pane guidance grooves.
Figure 2:
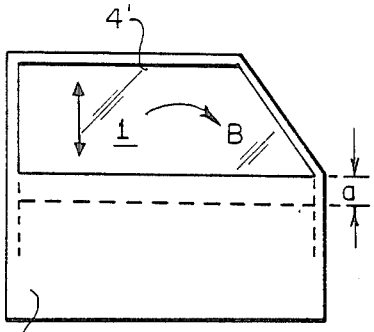
FIG. 2 is a schematic view of a motor vehicle door of a more recent type with a pane guidance groove shortened on one side.
Figure 3:
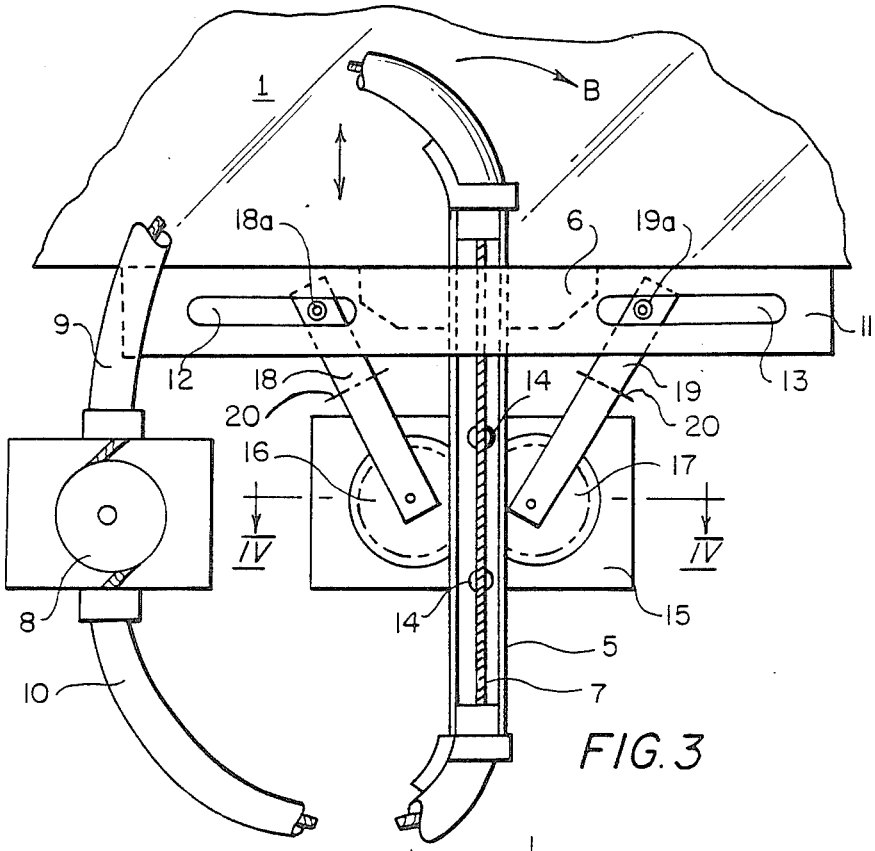
FIG. 3 is a view in elevation of the cable window lift of the present invention.

In FIGS. 1 through 3, the window pane is designated by (1), which is raised and lowered in a vehicle door (2) in the direction of the double arrow.

FIG. 1 shows a vehicle door of an earlier type with an additional small pivot window (3). In this design, the pane (1) is guided laterally in guide frames (4). It is easily seen that the lateral guidance length A is always the same length, regardless of the adjusted height of the pane. In this door design, the purpose of the window lift is merely to move the pane (1) up and down and the window lift need not brace or secure the pane against lateral tilting.

FIG. 2 shows a door (**2*a*) of a more recent design which eliminates the pivot window (3). In this door the panel (1) is secured against tilting into the direction of the arrow B only when in the upper position because then the edge of the pane enters the peripheral guide frame (4'**).

If, however, the pane is lowered merely by a small amount, the guidance remaining on the right side of FIG. 2 is merely a length "a". It is clear that the pane will now easily tilt in the direction of the arrow B.

Figure 4:
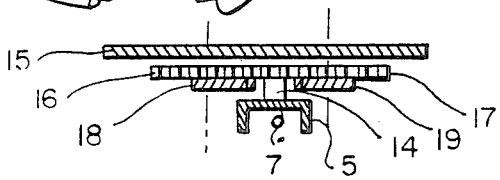
FIG. 4 is a cross-sectional view through FIG. 3, along the line IV—IV.

This tilting is prevented by the cable window lift shown in FIGS. 3 and 4. In these FIGS. 3 and 4, U-shaped guide rail (5) of the cable window lift drives implement (6) sliding on the rail (5) and being pulled by cable (7) which, in turn, is moved by drive roller (8). These components are known elements of cable window lifts and require no further discussion.

Wide brace (11) with an elongated slot (12) on one side and another slot (13) on the other side is connected with the drive implement (6), i.e. with pane (1).

Plate (15), supporting two meshing gears (16, 17), is mounted by means of two spacer pins (14) on guide rail (5). Each gear is solidly joined to a support arm (18, 19) of which the other ends each penetrate the elongated slots (12, 13) by means of pins (**18*a*, 19*a***).

Pane (1) now rests on pins (**18*a*, 19*a*) and thereby is secured against tilting in the direction of the arrow B. It is emphasized in this respect that the gears and the support arms are unrelated to driving the pane. As before the pane drive is carried out by cable (7) and drive implement (5) and possibly also by brace (11**) in the event the latter is solidly joined to the pane besides being joined to the drive implement. Therefore the gears and the support arms merely act to support the pane.

Additionally, the support arms may also be divided into two parts which are connected to a hinge for instance at the level of dash-dot line (20). This is advantageous where curved panes are concerned due to the fact that when curved panes are displaced they follow the arc of a circle.

Figure 5:
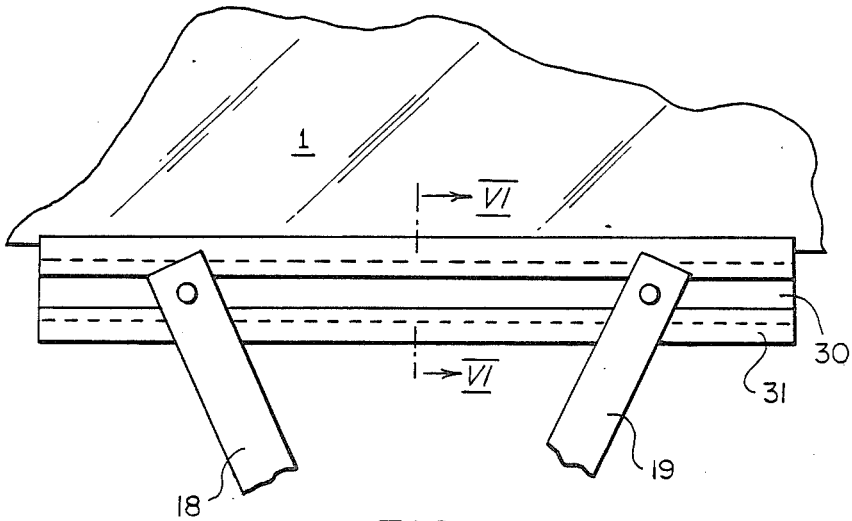
FIG. 5 is a view in elevation of a brace with a guidance groove.
Figure 6:
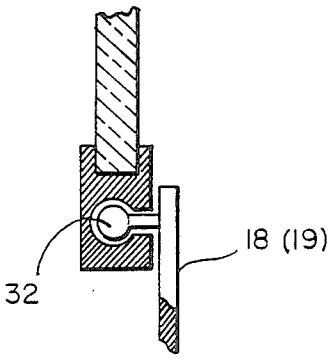
FIG. 6 is a cross-sectional view through FIG. 5 along the line VI—VI.

The engagement of the ends of the support arms in the brace in no way is restricted to the pin slot connection. For instance, as in FIGS. 5 and 6, a continuous groove 30 is provided in the direction of the elongated slots in the brace 31 and to be engaged in positive manner by balls 32 or other molded or shaped parts fixed to the ends of the support arms, whereby on the one hand the ends of the support arms are inserted laterally into the groove and, on the other hand, are simultaneously secured there against being pulled out perpendicularly to the pane's direction of motion.

A plurality of solutions exist for the approach described so far, especially as to where the gears are to be fixed to the support arms, and also on how to connect the support arms to achieve a constrained common but oppositely directed motion.

Figure 7:
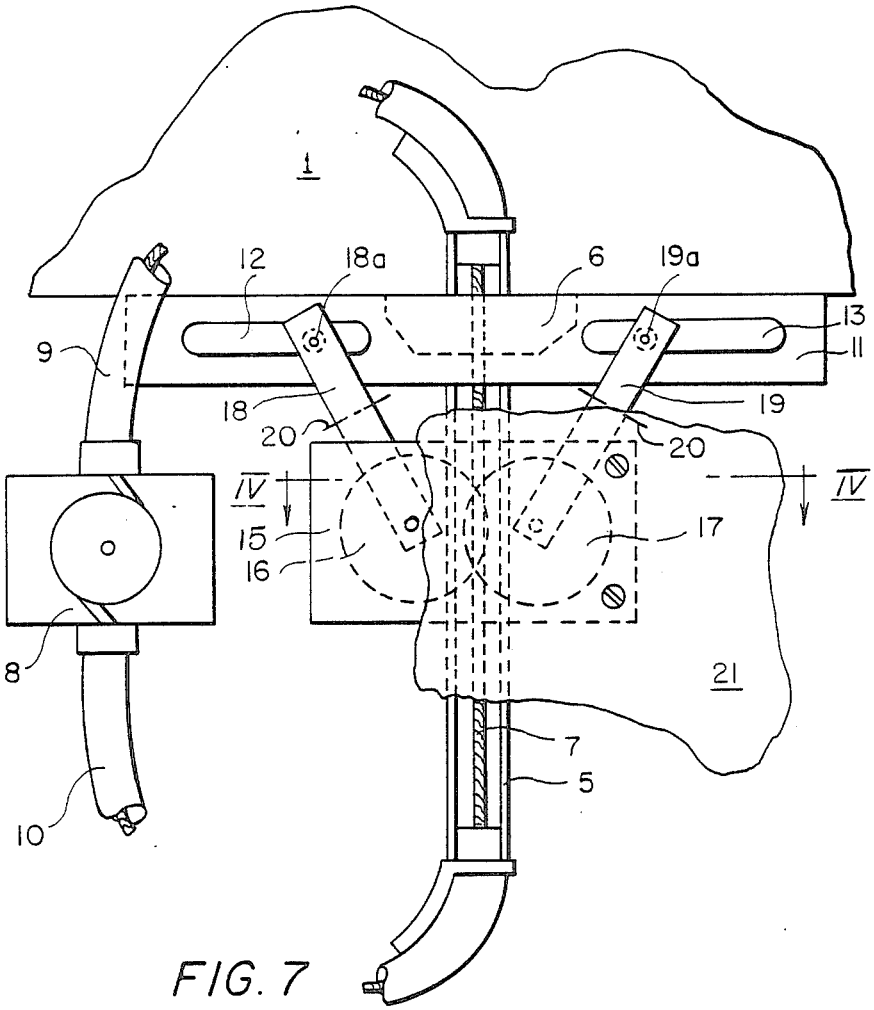
FIG. 7 is a view in elevation of a window lift of the present invention for which the gears or the support arms are mounted to a door wall.
Figure 8:
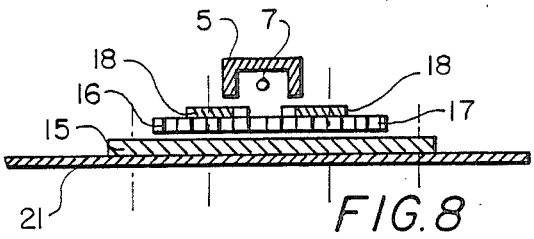
FIG. 8 is a cross-sectional view through FIG. 7 along the line VIII—VIII.

FIGS. 7 through 12 schematically show such specific embodiments. Whereas in the embodiment of FIGS. 3 and 4, the gears (16) and (17) are fixed to the guide rail (5), it is nevertheless quite feasible to mount the gears to a door wall, for instance to the inside wall of the door. This is shown in FIGS. 7 and 8. These show cutaway (21) of a door wall on which plate (15) is fixed, whereby gears (16) and (17) are supported apart from guide rail (5).

Figure 9:
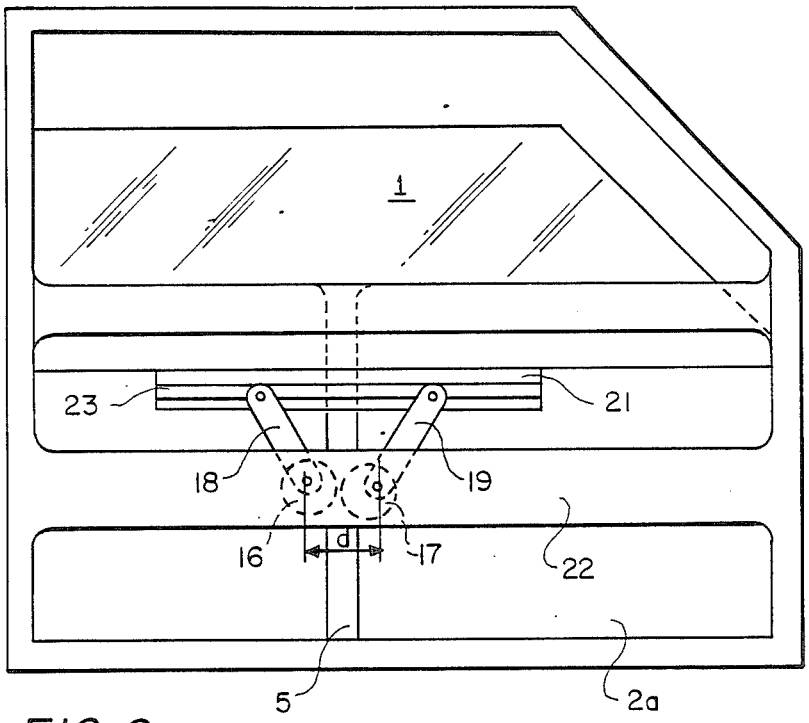
FIG. 9 is a schematic view showing the mounting of the gears to a crossbar in the door acting as a protective means.

Various vehicle doors contain a cross-bar acting as reinforcement and impact protection in case of accident. Where such a cross-bar is present in the door, gears (16, 17) may be supported directly on it. FIG. 9 schematically shows such an embodiment. Cross-bar (22) is mounted as a stiffening means in door (*2a*). Gears (16) and (17) together with their support arms (18) and (19) rest on this cross-bar.

These support arms (18) and (19) engage by their free ends the guide groove (23) of brace (11) mounted to the bottom of pane (1). Guide rail (5) is present in this embodiment in identical manner as in all other embodiments. The drive cable and the cable drum are omitted for simplicity.

Figure 10:
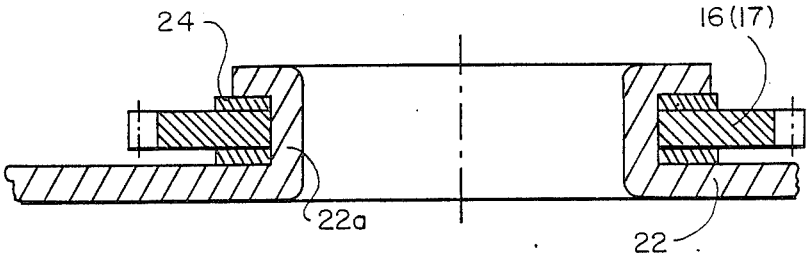
FIG. 10 is a view in partial cross-section showing the support of the gears directly in the door wall or a crossbar.

FIG. 10 shows how the gears are mounted on cross-bar (22) or also on door wall (21). A hole is stamped out of the door wall and the edges of this hole are drawn inward to form bearing sleeve (*22a*) making it possible to support each of the gears (16, 17) between two panes (24).

Figure 11:
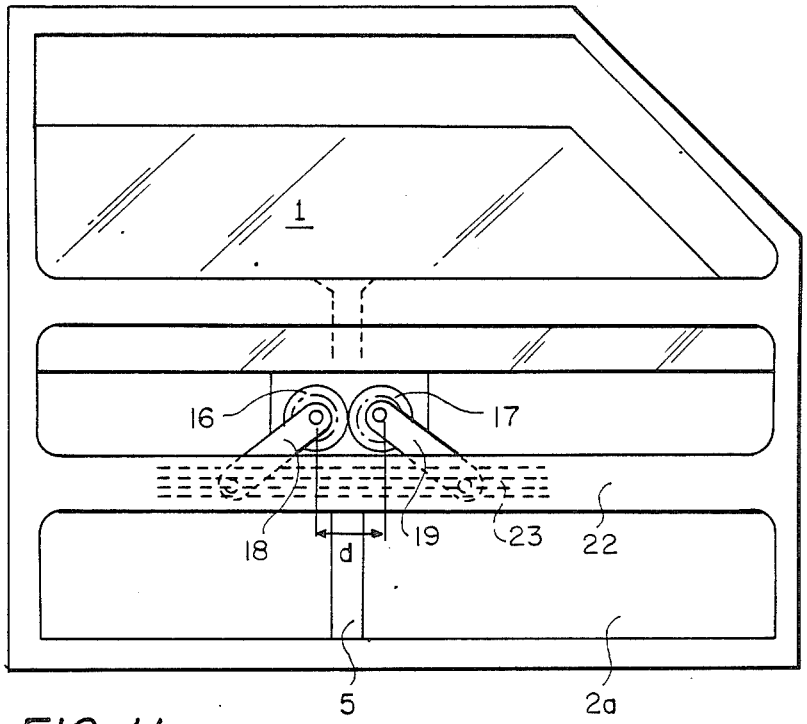
FIG. 11 is a schematic view of the window lift of the present invention for which the gears together with the support arms rest against the window.

The embodiment of FIG. 11 is the spatial inverse of the embodiment of FIG. 9. Whereas gears (16) and (17) of FIG. 9 are supported in cross-bar (22) and the guidance groove (22) is solidly joined to the window pane, the embodiment of FIG. 11 is precisely the reverse, i.e., gears (16, 17) are solidly (though rotatably of course) connected to window pane (1) whereas guidance groove (23) is mounted in cross-bar (22).

However, the support base of pane (1) against tilting is the same in both cases because this base is formed by the distance (d) between the centers of rotation of gears (16) and (17), and this base "d" is just as large in FIG. 9 as in FIG. 11. Both embodiments, however, make it plain that the pane support improves as the distance "d" increases and, accordingly, the support improves with larger gear diameter.

Figure 12:
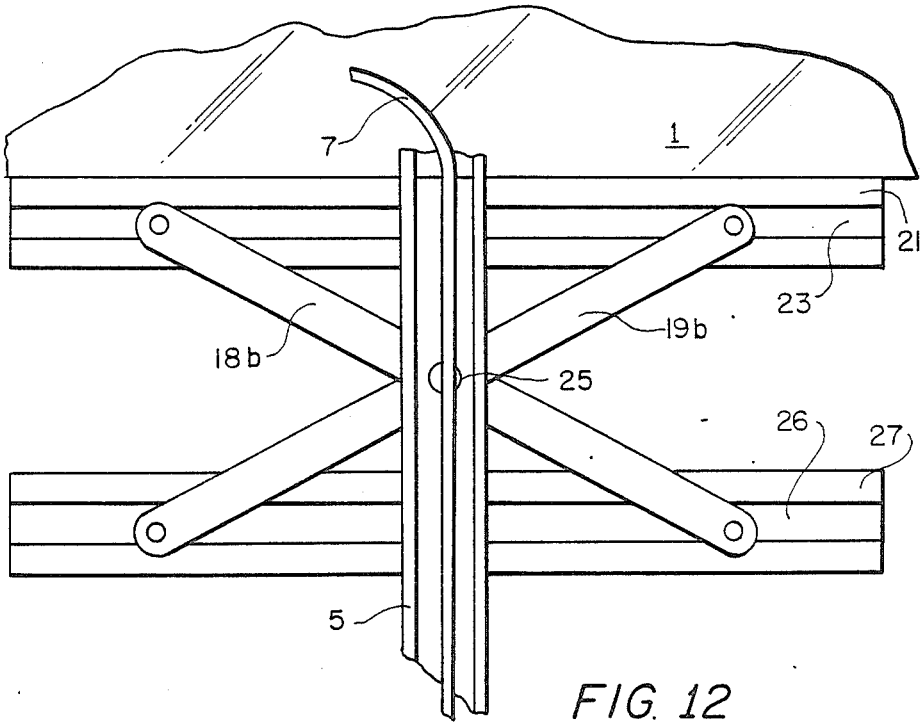
FIG. 12 is a schematic view which shows the window lift of the present invention with scissor-type support arms.

The illustrative embodiment of FIG. 12 shows that the operational connection of support arms (18) and (19) does not necessarily require gears. Other drive means are conceivable whereby the support arms would be suitably connected. In this embodiment, support arms (*18b, 19b*) have the same center of rotation (25) and engage guide grooves by their upper and lower ends. Thereby there is achieved again a solid connection between pane (1) and guide groove (23). The second guide groove (26) is mounted in an arbitrary but appropriate and fixed manner by plate (27) to the door. Accordingly, the two support arms operate like scissors. It must be borne in mind in this respect that the support arms are not being driven but, rather, join in the motion when the pane is displaced, and that they support this pane. The pane drive is implemented in all examples by cable (7).

What I claim is:

1. A cable window lift mounted in a vehicle for adjusting a one piece window pane with a plane having a shortened lateral groove guidance on one side of said pane, comprising:

(a) a vertical U-shaped guide rail;

(b) a continuous cable mounted for vertical movement in said guide rail;

(c) a drive roller connecting said cable for actuating said vertical movement;

(d) a brace joined to the lower edge of said window pane and having guidance groove means extending perpendicularly to said vertical U-shaped guide rail;

(e) means connecting said brace to said cable and for sliding on said guide rail; and (f) a first support arm having a first end engaging said guidance groove means and a second end rigidly joined to a first gear, a second support arm having a first end engaging said guidance groove means and a second end rigidly joined to a second gear, said first and second gears mutually meshing and mounted for rotation on a plate which, in turn, is mounted on said guide rail, whereby said support arms prevent tilting of said window pane in the direction of said plane of said window pane.

2. The cable window lift of claim 1, wherein said plate is fastened by a pivot through the centers of said gears.

3. The cable window lift of claim 2, wherein said second ends are mounted for rotation on said gears having sleeves rotatably supporting said gears by means of a centered base.

4. The cable window lift of claim 1, wherein said guidance groove means are two slots and said first ends have pins penetrating said slots.

* * * * *